US005265146A

United States Patent [19]

Wirth et al.

[11] Patent Number: 5,265,146

[45] Date of Patent: Nov. 23, 1993

[54] X-RAY TUBE ROTOR CONTROLLER USING THE MAIN HIGH VOLTAGE INVERTERS FOR ACCELERATION AND SPEED MAINTENANCE

[75] Inventors: William F. Wirth, Sullivan, Wis.; Gerald K. Flakas, Westminster, Colo.

[73] Assignee: General Electric Company, Milwaukee, Wis.

[21] Appl. No.: 976,765

[22] Filed: Nov. 16, 1992

[51] Int. Cl.[5] ..... H05G 1/66

[52] U.S. Cl. ..... 378/93; 378/91; 378/101; 378/131

[58] Field of Search ..... 378/93, 91, 101, 114, 378/115, 116, 105, 106, 107, 131; 363/71, 98; 318/85, 800, 801, 809

[56] References Cited

U.S. PATENT DOCUMENTS 4,247,776 1/1987 Seifert ..... 378/93
4,829,551 5/1989 Resnick et al. ..... 378/131
5,060,252 10/1991 Vogler et al. ..... 378/93
5,200,645 4/1993 Laeuffer ..... 363/71

*Primary Examiner*—David P. Porta
*Attorney, Agent, or Firm*—James O. Skarsten

[57] ABSTRACT

An x-ray tube rotor controller uses the main high voltage inverters for acceleration and speed maintenance. The rotor controller includes a DC voltage source, and a rotary anode drive circuit including a rotary anode motor designed as a two-winding induction motor. The rotor controller comprises first and second inverter circuits which may be either half bridge or full bridge arrangements, the first and second inverter circuits for accelerating the anode, and further for generating high voltage for the x-ray tube. Electronic switching means allow for instantaneous electronic switching of the output of the first and second inverter circuits between the high voltage power supply and the anode motor. A phase switching capacitor may be used to provide the other phase of the motor.

6 Claims, 3 Drawing Sheets

X-RAY TUBE ROTOR CONTROLLER USING THE MAIN HIGH VOLTAGE INVERTERS FOR ACCELERATION AND SPEED MAINTENANCE

TECHNICAL FIELD

The present invention relates to an x-ray tube rotor controller and, more particularly, to x-ray systems where two separate inverters are used to generate the high voltage for the tube.

BACKGROUND ART

X-ray tubes used in medical diagnostic imaging are built with a rotating anode structure for the purpose of distributing the heat generated at the focal spot. This anode is rotated by an induction motor consisting of a cylindrical rotor built into a cantilevered axle that supports the disc shaped anode target, and an iron stator structure with copper windings that surrounds the elongated neck of the x-ray tube that contains the rotor. This induction motor requires a source of alternating current which is normally supplied from the power mains or an inverter.

A typical state-of-the-art x-ray diagnostic system uses a high frequency inverter to supply alternating current to a step up transformer and rectifier/filter circuit that generates the high voltage DC power required by the x-ray tube. A separate inverter supplies AC voltage to the induction motor that rotates the anode. This second inverter is sized to quickly accelerate the anode to about 10,000 RPM and is typically rated about 10 KVA. Once the anode is up to rated speed, the load drops to a very small percentage of rated, due to absence of air friction in the vacuum inside the tube.

In U.S. Pat. No. 4,377,002, the anode drive induction motor is accelerated by using one leg of a full bridge inverter and an additional DC voltage source tapped at its midpoint to form a half bridge. During this time, the other leg of the full bridge is deenergized so as to prevent any voltage from being applied to the x-ray tube load. Once the anode is up to speed, the motor is disconnected and the anode is allowed to coast. Unfortunately, the switching means for switching from motor operation to x-ray generation and back again, is a mechanical switching means which creates time delays and mechanical wear problems in the system, as well as increasing the cost of the system.

It would be desirable then to have a rotor controller wherein the time delays and mechanical wear problems of electromechanical switching are overcome.

SUMMARY OF THE INVENTION

The present invention is a system and method wherein a pair of inverters normally used to generate the high voltage for the x-ray tube are used to accelerate the anode and to maintain the rotor at speed between the short periods of time of the x-ray exposures. During the time the inverters are being used to generate high voltage power for the x-ray exposure, the induction motor is electronically deenergized by the phasing of the pair of inverters and the tube target is allowed to coast. At the end of the exposure, the power to the x-ray tube is terminated by deenergizing all of the inverter legs, and the motor is reenergized by operation of one leg from each inverter at the start frequency and at the phase angle required to maintain running speed.

With the x-ray tube rotor controller of the present invention, the output of the inverters may be switched electronically between the high voltage power supply and anode motor with virtually no time delay. This is an improvement on the prior art in that mechanical switching is eliminated, which allows instantaneous change from motor operation to x-ray generation and back without the time delays and other problems associated with electromechanical switching.

In accordance with one aspect of the present invention, an x-ray tube rotor controller uses the main high voltage inverters for acceleration and speed maintenance. The rotor controller includes a DC voltage source, and a rotary anode drive circuit including a rotary anode motor designed as a two-winding induction motor. The rotor controller comprises first and second inverter circuits each having an output, the first inverter circuit having a full bridge arrangement with a first right leg and a first left leg, and the second inverter circuit having a full bridge arrangement with a second right leg and a second left leg, the first and second inverter circuits for accelerating the anode, and further for generating high voltage for the x-ray tube. Electronic switching means allow for instantaneous electronic switching of the output of the first and second inverter circuits between the high voltage power supply and the anode motor. A phase shifting capacitor may be used to provide the other phase of the motor.

In one alternative embodiment, the phase shift capacitor may be eliminated and the other phase of the motor is then derived from the other leg of each inverter circuit. In another alternative embodiment, the two full bridge inverter circuits may be replaced with a pair of half bridge inverter circuits.

Accordingly, it is an object of the present invention to provide an x-ray tube rotor controller to eliminate mechanical switching and allow instantaneous change from motor operation to x-ray generation.

Other objects and advantages of the invention will be apparent from the following description, the accompanying drawings and the appended claims.

DETAILED DESCRIPTION OF THE PREFERRED EMBODIMENTS

The present invention relates to an x-ray system whereby two separate inverters are used to generate the high voltage for the x-ray tube.

Figure 1:
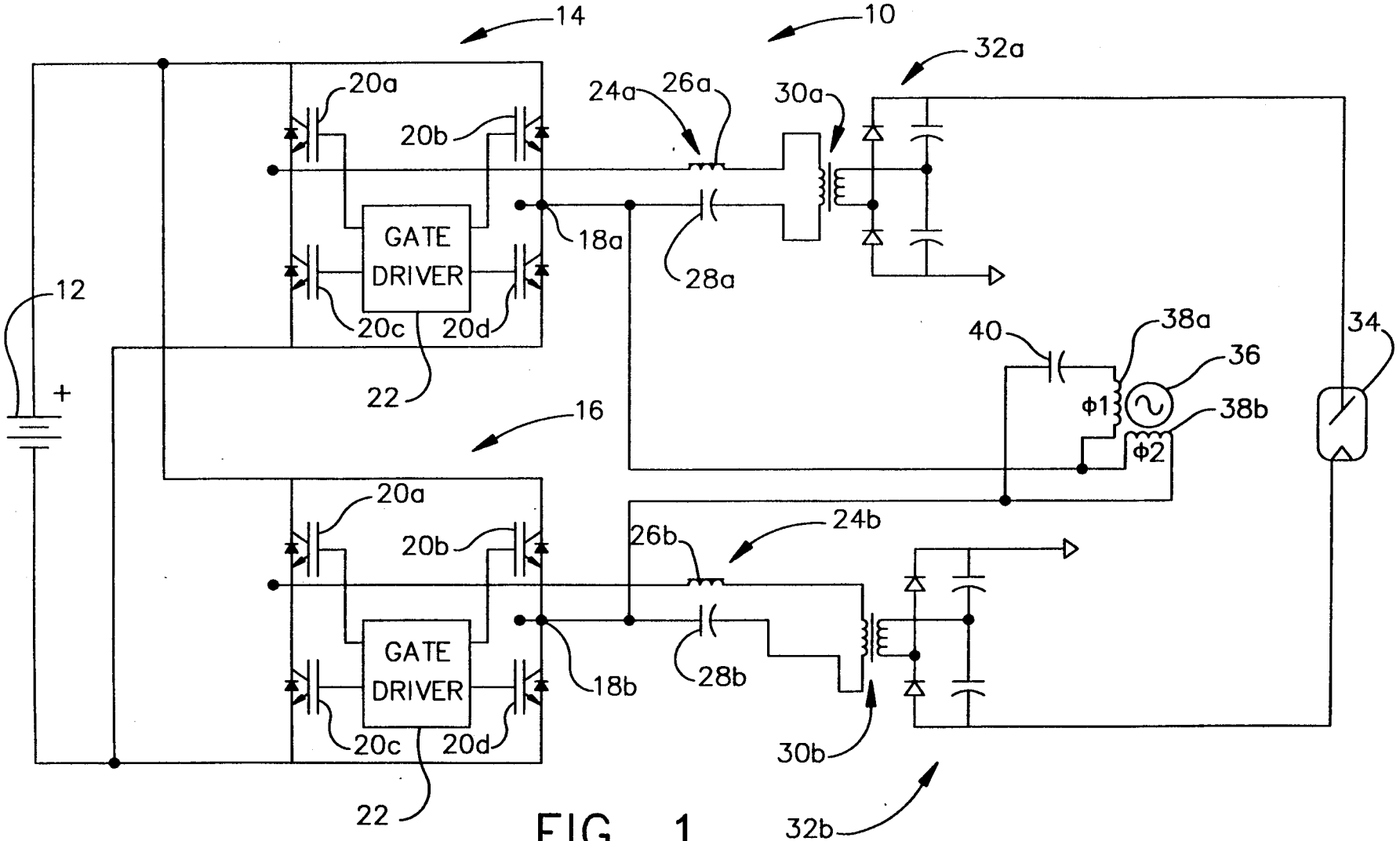
FIG. 1 is an electric circuit diagram, in accordance with one embodiment of the present invention.

Referring now to the drawings, FIG. 1 illustrates an x-ray tube rotor controller electric circuit 10 in accordance with one embodiment of the present invention. The invention shown in FIG. 1 includes a DC voltage source 12 for providing voltage to a first full bridge inverter 14 and a second full bridge inverter 16. Nodes 18*a* and 18*b* indicate the mid-points of the right legs of the two inverters 14 and 16, respectively. Each inverter 14 and 16 comprises four electronic switches 20*a*, 20*b*, 20*c* and 20*d*, and a gate driver 22. The electric circuit 10 further includes a first resonant circuit 24*a* comprised of a series connected inductor 26*a* and capacitor 28*a* and a second resonant circuit 24b comprised of a series connected inductor 26b and capacitor 28b. High voltage step up transformers 30a and 30b, each with a rectifier and filter circuit 32a and 32b, respectively, comprise a series connected output for an x-ray tube 34. The resonant circuit 24a, the transformer 30a, and the filter circuit 32a, comprise a high voltage power supply for the first inverter 14. Likewise, the resonant circuit 24b, the transformer 30b, and the filter circuit 32b, comprise a high voltage power supply for the second inverter 16. An induction motor 36 having two windings 38a and 38b for driving the x-ray tube 34 anode, and a phase shifting capacitor 40, are connected to one leg of each full bridge inverter.

In FIG. 1, the motor 36 and phase shifting capacitor 40 are shown as being connected between the right legs of the two full bridge inverters 14 and 16. Of course, it will be obvious to those skilled in the art that the motor 36 and capacitor 40 may be connected between the left legs of the inverters 14 and 16, or between one left leg and one right leg of each inverter 14 and 16.

Continuing with FIG. 1, the motor 36 and phase shifting capacitor 40 are connected to nodes 18a and 18b. To start the motor 36 in this arrangement, the left legs are left deenergized to prevent x-rays from being generated, and the right legs are operated 180° out of phase with each other at the start frequency of the motor 36. This applies a bipolar square wave of voltage on the motor windings 38a and 38b which produces torque on the rotor and starts the acceleration toward synchronous speed, for instance 10,800 RPM for a start frequency of 180 Hertz.

Once synchronous speed is reached, the applied voltage may be reduced by operating at phase angles of less than 180°. In fact, the AC voltage on the windings may be reduced to zero by operation at 0° phase shift, wherein the inverter 14 and 16 legs are in synchronism. Consequently, for half of the operating time the nodes 18a and 18b would be connected together to a positive voltage bus, and the other half of the time the nodes 18a and 18b would be connected together to a negative bus. At all times, then, the net voltage difference between the nodes would be zero.

Having accelerated to running speed and adjusted the voltage on the motor to that required to maintain that speed, the motor may be operated in this state indefinitely until an x-ray exposure is required. At this time, in the embodiment shown in FIG. 1, the motor 36 may be deenergized and left to coast by operating the right inverter legs in synchronism. The right and left legs of the inverters 14 and 16 are then operated at the frequency required to generate high voltage on the x-ray tube 34 and the motor 36 remains in an electrically deenergized state as long as the right legs, in the embodiment shown in FIG. 1, are in synchronism. At the end of the x-ray exposure, typically 100 milliseconds, the power to the x-ray tube 34 is terminated by deenergizing all of the inverter 14 and 16 legs, and the motor is reenergized by operation of one leg of each inverter 14 and 16 at the start frequency and at the phase angle required to maintain running speed. Thus, the output of the inverters 14 and 16 may be switched electronically between the high voltage power supply and anode motor with virtually no time delay.

Figure 2:
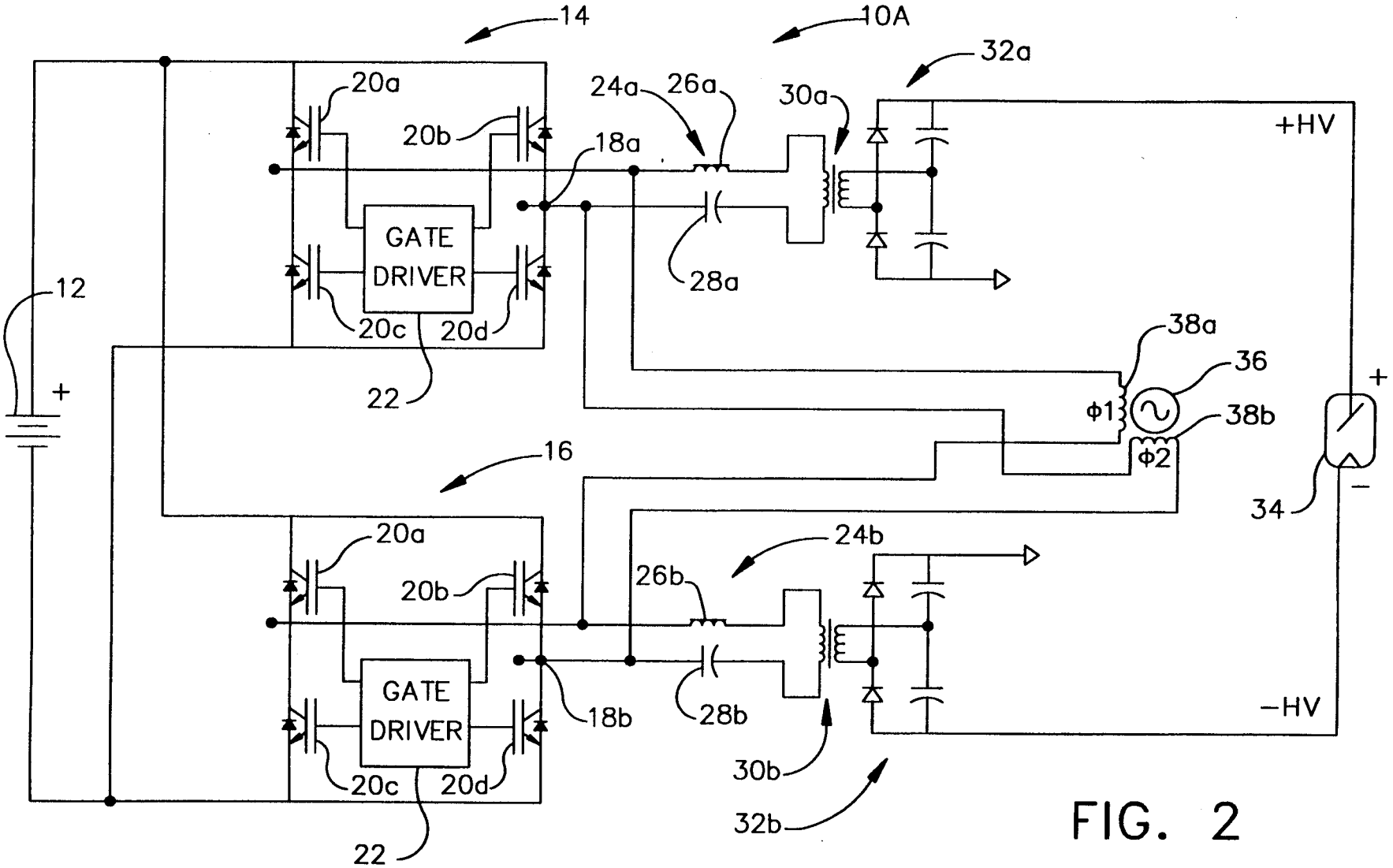
FIG. 2 is an electric circuit diagram as shown in FIG. 1, in accordance with an alternative embodiment of the present invention.

It will be obvious to those skilled in the art that various modifications and variations of the present invention are possible without departing from the scope of the invention, which provides a technique for electronically switching from motor operation to x-ray generation. For example, referring now to FIG. 2, there is illustrated a circuit 10A, which is an alternative embodiment of the present invention. In the embodiment illustrated in FIG. 2, the second phase of the motor 36 is derived from the left legs of the inverters 14 and 16, instead of the usual phase shifting capacitor 40. The advantage of the embodiment shown in FIG. 2 is that the phase shifting capacitor 40 is eliminated. However, the low frequency motor voltage may not be completely blocked by the resonant capacitor, with the result that a low non x-ray producing voltage is produced across the tube.

As in FIG. 1, the circuit 10A of FIG. 2 includes a DC voltage source 12 for providing voltage to a first full bridge inverter 14 and a second full bridge inverter 16. The electric circuit 10A further includes the first resonant circuit 24a comprised of the series connected inductor 26a and capacitor 28a; and the second resonant circuit 24b comprised of the series connected inductor 26b and capacitor 28b. High voltage step up transformers 30a and 30b, each with the rectifier and filter circuit 32a and 32b, respectively, comprise the series connected output for the x-ray tube 34. Finally, the circuit 10A of FIG. 2 includes the induction motor 36 having two winding 38a and 38b for driving the x-ray tube 34 anode.

The circuit 10A of FIG. 2, then, is similar to the circuit 10 of FIG. 1, except that the phase shift capacitor 40 of FIG. 1 has been eliminated, and the first phase of the induction motor 36 has been reconnected between the left legs of the two full bridge inverters 14 and 16. Again, it will be obvious to those skilled in the art that the first phase of the motor 36 may be connected between the right legs of the inverters 14 and 16, or between one left leg and one right leg of each inverter 14 and 16. This first phase is generated in the same manner as the second phase described above in relation to FIG. 1, but in a quadrature phase relationship in order to produce torque in the two phase anode motor 36.

Figure 3:
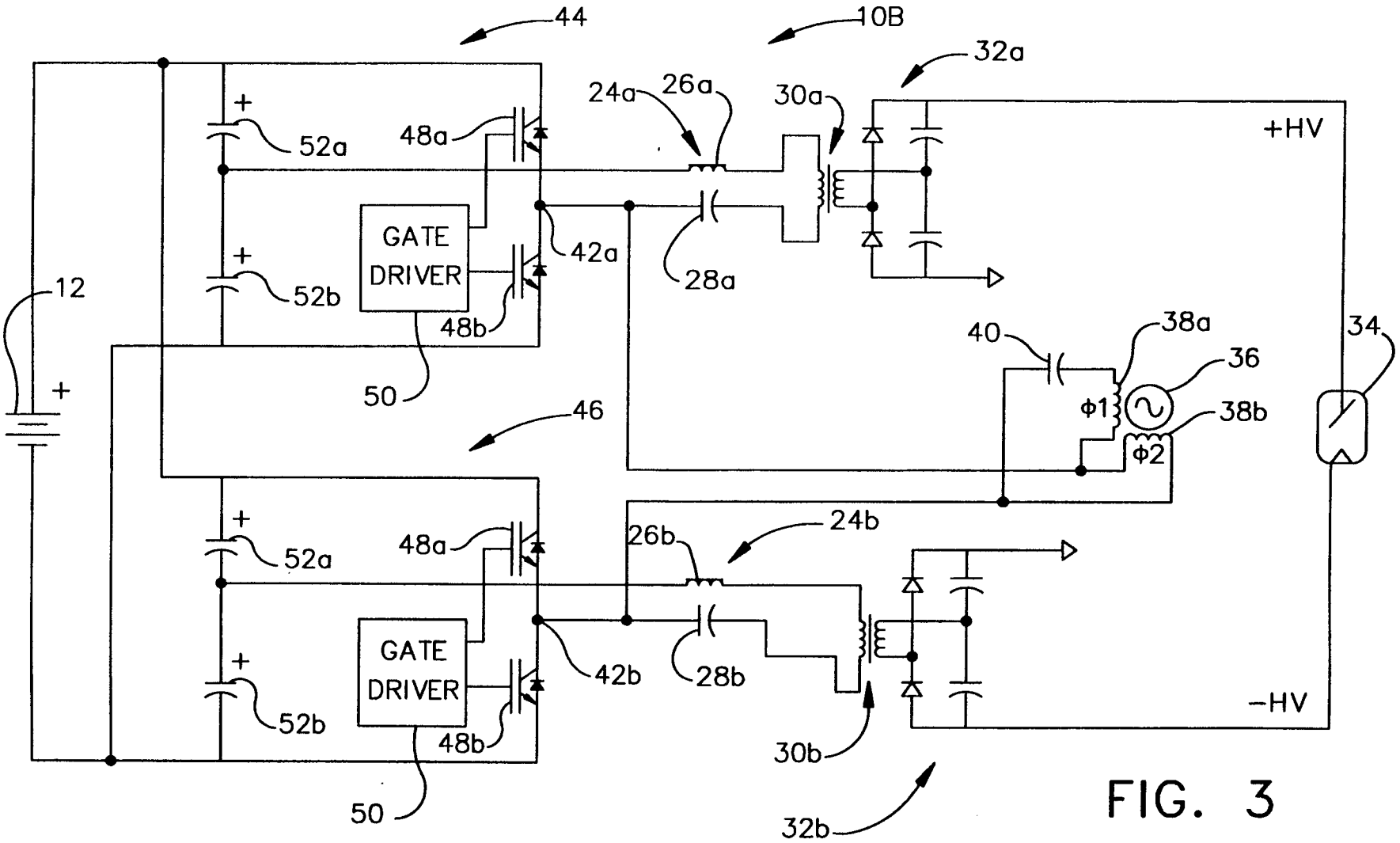
FIG. 3 is an electric circuit diagram similar to the circuit shown in FIG. 1, in accordance with a third embodiment of the present invention.

Another embodiment is shown in FIG. 3, where an x-ray tube rotor controller electric circuit 10B includes a pair of half bridges 44 and 46 to replace the full bridges 14 and 16 of FIG. 1. Nodes 42a and 42b indicate the mid-points of the right legs of the two inverters 44 and 46, respectively. Each half bridge inverter 44 and 46 comprises two electronic switches 48a and 48b, and a gate driver 50. Capacitors 52a and 52b provide a mid-point voltage for the half-bridges. Otherwise, like circuit elements use the same reference numbers as used in FIG. 1 above. The embodiment illustrated in FIG. 3 is useful in situations where it is desirable to minimize costs by having fewer components. However, while in the motor run mode, the low frequency is not completely blocked by the resonant capacitor.

The invention has been described in detail with particular reference to certain preferred embodiments thereof, but it will be understood that modifications and variations can be effected within the spirit and scope of the invention.

We claim:

1. An x-ray tube rotor controller having an x-ray tube anode and a rotor, the x-ray tube rotor controller comprising:

a DC voltage source;

an anode drive induction motor having a first winding and a second winding, for driving the x-ray tube anode;

first and second inverter circuits each having an output and a full bridge arrangement, the first and second inverter circuits for accelerating the anode, and further for generating high voltage in a high voltage supply for the x-ray tube;

electronic switching means for instantaneous electronic switching of the output of the first and second inverter circuits between the high voltage power supply and the anode motor.

2. An x-ray tube rotor controller as claimed in claim 1 further comprising:

means for accelerating the anode by connecting one winding of the induction motor across first legs of the first and second inverter circuits and another winding of the induction motor across second legs of the first and second inverter circuits for accelerating the anode, the first legs of the first and second inverter circuits being operated out of phase with each other, and the second legs of the first and second inverter circuits being operated out of phase with each other;

means for maintaining anode speed by reducing the phase angle; and means for deenergizing the motor and allowing the rotor to coast by operating one leg of the first inverter circuit and one leg of the second inverter circuit in synchronism.

3. An x-ray tube rotor controller as claimed in claim 1 further comprising a phase shifting capacitor connected to a winding of the motor to provide a second phase of the motor.

4. An x-ray tube rotor controller as claimed in claim 2 wherein the second phase of the induction motor is generated in a quadrature phase relationship to produce torque in the two phase anode motor.

5. An x-ray tube rotor controller having an x-ray tube anode and a rotor, the x-ray tube rotor controller comprising:

a DC voltage source;

an anode drive induction motor having a first winding and a second winding, for driving the x-ray tube anode;

first and second inverter circuits each having an output and a half bridge arrangement, the first and second inverter circuits for accelerating the anode, and further for generating high voltage in a high voltage power supply for the x-ray tube;

electronic switching means for instantaneous electronic switching of the output of the first and second inverter circuits between the high voltage power supply and the anode motor.

6. An x-ray tube rotor controller as claimed in claim 5 further comprising a phase shifting capacitor connected to a winding of the motor to provide a second phase of the motor.

* * * * *